US005655337A

United States Patent [19]

Bryant et al.

[11] Patent Number: 5,655,337

[45] Date of Patent: Aug. 12, 1997

[54] TEMPORARY MATERIAL INSTALLATION SUPPORT DEVICE AND METHOD OF USE THEREOF

[76] Inventors: Carroll D. Bryant, 74 Frans Dr., Abingdon, Md. 21009; Karl U. Hairston, 159 S. Monastery Ave., Baltimore, Md. 21229

[21] Appl. No.: 528,792

[22] Filed: Sep. 18, 1995

[51] Int. Cl.[6] ..... E04F 21/18; E04G 21/14

[52] U.S. Cl. ..... 52/127.2; 52/747.1; 52/749.1; 414/11

[58] Field of Search ..... 52/127.2, 745.05, 52/749.1, 741.1, 747.1, 127.1; 248/317, 216.1, 320, 323, 327, 546, 544, 342, 343, 354.1; 414/11

[56] References Cited

U.S. PATENT DOCUMENTS

| | | | |
|---|---|---|---|
| 1,230,093 | 6/1917 | Adey | 52/127.2 |
| 3,953,015 | 4/1976 | Taylor et al. | 248/317 |
| 4,340,205 | 7/1982 | Leezer | 414/11 |
| 4,449,338 | 5/1984 | Reicherts | 52/749.1 |
| 4,709,527 | 12/1987 | Cooley | 52/749.1 |
| 4,826,390 | 5/1989 | Paxton | 414/11 |
| 4,867,403 | 9/1989 | Anderson | 248/216.1 |
| 5,224,309 | 7/1993 | Bodell | 52/749.1 |
| 5,329,744 | 7/1994 | Sumter | 52/749.1 |
| 5,371,994 | 12/1994 | Waters | 52/749.1 |
| 5,397,207 | 3/1995 | Arellano et al. | 414/11 |

FOREIGN PATENT DOCUMENTS

| | | | |
|---|---|---|---|
| 2653469 | 4/1991 | France | 52/127.2 |
| 405033419 | 2/1993 | Japan | 52/127.2 |

*Primary Examiner*—Robert W. Gibson, Jr.
*Assistant Examiner*—Ronald J. Wallace
*Attorney, Agent, or Firm*—Walter G. Finch

[57] ABSTRACT

The present invention relates to a drywall support device. More particularly, this invention relates to a drywall support device for temporarily attaching a sheet of drywall to a ceiling for easier permanent attachment by using a lift system to raise the sheet of drywall to the ceiling. This device is an elongated support which allows for "hands-free" permanent attachment of sheets of material to both conventional or irregularly sloped ceilings. The device has three essential components: (1) a pair of ceiling joist support brackets; (2) an elevatable drywall support; and (3) a threaded screw-type mechanism with a handle to raise the elevatable support to a desired elevation.

11 Claims, 2 Drawing Sheets

TEMPORARY MATERIAL INSTALLATION SUPPORT DEVICE AND METHOD OF USE THEREOF

BACKGROUND OF THE INVENTION

With the advent of sheet sections of walling, craftsmen skilled in applying a perfectly even wall of plaster needed to transform their skills to keep up with technology. Sheet rock or dry wall has successfully replaced the entirely plastered wall and forced carpenters to lay down their plaster troughs and spreaders in exchange for cordless drywall screw guns.

Hanging sheet rock or drywall on a vertical surface is a relatively simple task. A four by eight foot sheet is butted against adjacent foundations and secured to wood or metal framing with screws. The only patch work required is to cover the countersunk screws and the seams between adjacent pieces. The rest of the four by eight sheet is manufactured flat and requires no additional work besides the standard two coats of paint.

While drywall has been a triumphant replacement for plastering walls, it has several very serious shortcomings when used on ceilings. Specifically, the sheets are very large, awkward and heavy, making it impossible for one person to hang a sheet on the ceiling and next to impossible for two people. This problem directly relates to the cost of the job as a second workman is needed solely to support the sheet against the ceiling, assuming the sheet makes it to the ceiling without damaging the material. Several inventions have obtained patents to assist a carpenter in hanging drywall on ceiling joists without human support.

One of the first types of devices designed to assist in hanging drywall on the ceiling is known commonly as a dead man's support. This type of support extends from the floor to the ceiling temporarily forcing the drywall flat against the ceiling until it can be permanently fastened. A patent on a device such as this was issued to Molloy in U.S. Pat. No. 4,733,844 in 1988 and again on an improvement, U.S. Pat. No. 4,928,916, in 1990.

This type of device does little to alleviate the need for a second worker though. A sheet of drywall must be placed flat against the ceiling before the device will support it fully. While eliminating the need to manually hold the sheet while permanently attaching it, this device almost requires a third person as the sheet must be properly positioned while the device is being operated. Furthermore, use of this device on vaulted or cathedral ceilings becomes almost more trouble and time consuming to set up than would having three or four workers manually hold the sheets flat against the joists.

Several devices have been devised to assist in temporarily attaching sheets of material to high or angled ceilings. Additionally, these devices allow for a temporary support of the material without the use of the floor for support. U.S. Pat. Nos. 5,366,329, issued to Burgess, and 5,249,405, issued to Miller, are illustrative of typical devices in the art which do not use floor support. These two and other devices of this type attach temporarily to the ceiling and have some sort of shelving means which the sheet of drywall rests upon. Once the sheet is permanently attached, the temporary support device is removed and used on the next sheet.

This method is only a slight improvement over the dead man's support as a sheet of drywall needs to be placed in position first, manually, while the support devices attaching at least one end of the sheet are secured. Furthermore, some of these devices, such as in Miller, require more than two individual devices to support a single sheet of drywall. In this case, the devices hardly improve the manual method of attaching sheets to the ceiling as permanent attachment will only require minimal additional effort to that of attaching four temporary supports.

What is needed is a new and novel apparatus for hanging sheets of drywall on the ceiling which can be attached first to the ceiling without the drywall, have the drywall inserted within it, and then have the apparatus lift and support the drywall against the ceiling until it is permanently attached. The present invention fulfills this and other needs.

SUMMARY OF THE INVENTION

The present invention relates to a drywall support device. More particularly, this invention relates to a drywall support device for temporarily attaching a sheet of drywall to a ceiling for easier permanent attachment by using a lift system to raise the sheet of drywall to the ceiling. This device is an elongated support which allows for "hands-free" permanent attachment of sheets of material to both conventional or irregularly sloped ceilings. The device has three essential components: (1) a pair of ceiling joist support brackets; (2) an elevatable drywall support; and (3) a threaded screw-type mechanism with a handle to raise the elevatable support to a desired elevation.

The two joist attachments are at the extreme ends of the elevatable support and secure the device to the ceiling with screws. Once attached with screws, a sheet of material is fed into the elevatable support, which is in its lowered position thereby accepting the material easily. Once the sheet of material is placed and balanced on the elevatable support, the handle is rotated. As the handle is rotated, the elevatable support rises, as does the sheet of material, due to the threaded portion of the handle contacting the elevatable support. When fully elevated, the device presses a sheet of material firmly against the ceiling, allowing permanent installation to proceed easily.

When permanent installation is complete, the handle is counter-rotated, to lower the elevatable support, and the ceiling joist attachments are released. The devise can now be reattached to the ceiling joists at another position for mounting the next piece of material.

It is therefore an object of this invention to make it easier to hang sheets of material on conventional or irregularly sloped ceilings.

It is another object of this invention to create a device that allows a single person to hang sheets of material on ceilings.

It is another object of this invention to create a device for hanging sheets of material on ceilings that is fully attached to the ceiling before the sheet of material is supported, thereby alleviating the need to manually support the material while installing a temporary support device.

It is still a further object of this invention to provide a temporary support device for sheets of material to be hung on ceilings that adjustably applies pressure to the material, pressing it securely against the ceiling without crushing or damaging the material.

DETAILED DESCRIPTION OF THE DRAWINGS

Figure 1:
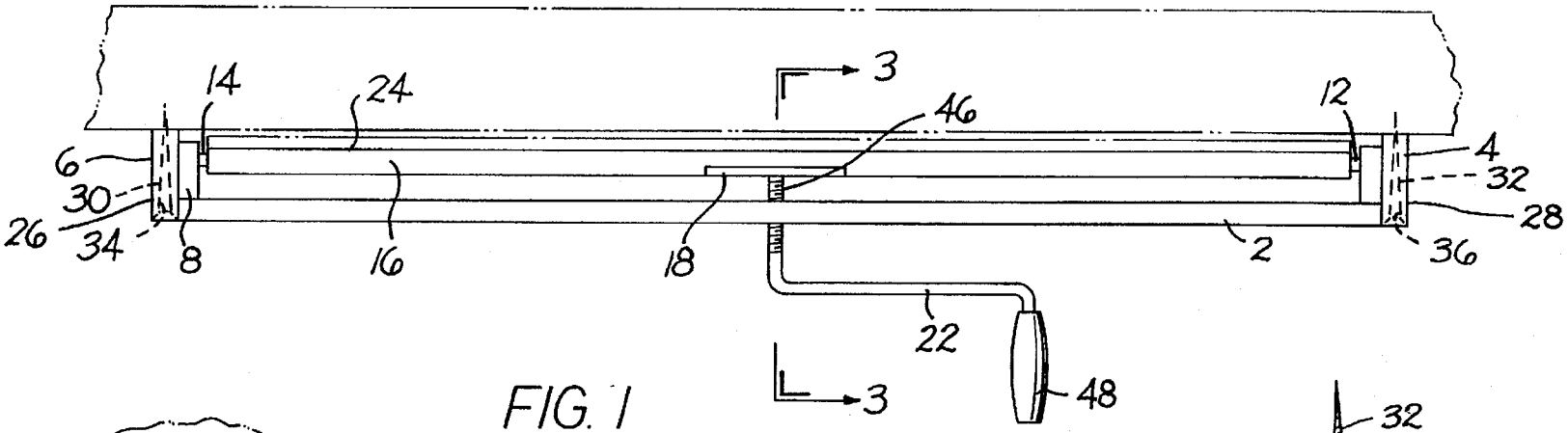
FIG. 1 is a side elevation of the device illustrating generally the novel feature illustrated specifically in FIGS. 2, and 3.

The present invention is clearly depicted in FIG. 1. By reference to that illustration, this invention will be understood in greater detail. The device is to be constructed of a rigid but also lightweight material, such as aluminum, plastic, or wood, to facilitate functionality without circumventing the purpose of its inception, alleviating the need to lift heavy objects such as a sheet of drywall material. The main body of the device is comprised of three separate components: (1) a support body 2; (2) a left support bracket 6; and (3) a right support bracket 4.

The support brackets 6 and 4 are permanently and perpendicularly attached to the top face of the support body 2. This provides the device with additional support when attached to the ceiling and loaded and reduces stress on the support bracket 4, 6—support body 2 connection as the retaining screws 30, 32 compress this connection rather then depending on it for support. This type of connection is essential to the preferred embodiment, if a unitary design is not used, as it reduces wear and fatigue, thereby maximizing the device's life.

The device is attached to the ceiling by two screws 30, 32 sufficiently long enough to penetrate both the support body 2, a support bracket 4 or 6. The screws 30 and 32 securely pierce and become embedded within the ceiling joists.

The elevating member 16, resides in between the two support brackets 4 or 6 and is parallel to and just slightly shorter in length than the support body 2. The elevating member 16 is slidably connected at each end to a support bracket 4 or 6. In the preferred embodiment, the slidable connection is a pin 12, 14 and guide 8, 10 combination.

Figure 2:
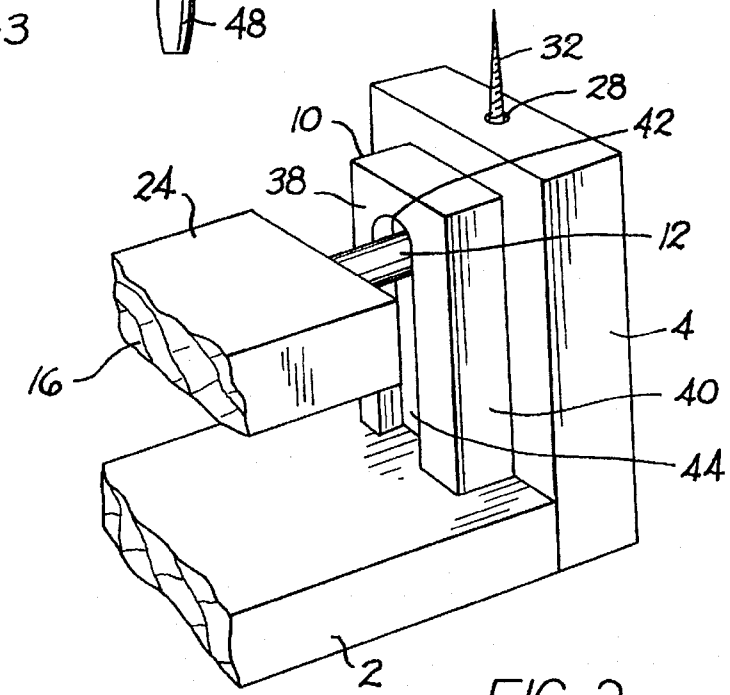
FIG. 2 is an enlarged isometric illustration of the guide mechanism and support bracket.

Realizing that the slidable connection means is identical on both sides of the device, FIG. 2 allows for a complete understanding of the mechanism utilized in its isolated illustration of the right side support bracket 4, right side pin 12, and right side guide 10. The guide 10 is formed from two straight guide rails 38, 40 and a semi-circular cap 42. The guide can be three separate pieces, or unitarily connected as shown in FIG. 2.

Since the cap 42 and the support body 2 are located on both ends of the parallel situated rails 38, 40, a closed slot 44 is formed. This slot is sufficiently wide enough, due to proper spatial positioning of rails 38 and 40, to accept a pin 12 extending axially from the cross sectional center of the elevating member 16. The slot 44 and the pin 12 are of proper geometrical relation to allow simultaneously for a snug fit and sliding movement. Other means of accomplishing this function, such as variations on positioning or configurations of the guide 10 and pin 12 or increasing the multiplicity of guide and pin combinations are not outside the contemplation of this applicant or the scope of the claims defining this invention.

Figure 3:
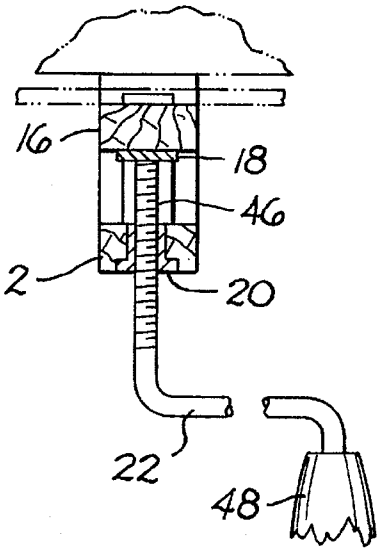
FIG. 3 is an enlarged illustration of the elevating means, showing the threaded insert and handle.

The lifting means is shown in FIG. 3 and is considered to be the preferred embodiment for accomplishing the lifting, but the applicant contemplates any method of lifting equivalent or well known in the art as does the scope of the claims. The essential components include a a handle 22, a threaded insert 20 embedded at the approximate lengthwise and widthwise center of the support body 2, and an elevation plate 18 located on the center portion of the bottom face of the elevating member 16.

The handle 22 has two ninety degree bends with a sufficient moment arm between them to provide an appropriate degree of leverage to assist a workman in the elevating process. At one extreme end of the handle, threads 46, of an opposite nature to that of the threaded insert 20, engage the insert 20 and increasingly permeate the support body 2 as the handle is turned in a tightening direction. The opposite end of handle incorporates a handgrip 48, capable of independent rotation to assist in the overall cranking motion.

Once the threaded end 46 of the handle 22 penetrates the entire thickness of the support body 2, it contacts the bottom face of the elevating member 16 in the approximate center of the elevating plate 18. Continuing rotation of the handle 22 further extends the threaded end 46 out of the support body 2, applying a lifting force on the elevation plate 18. This raises the elevating member from its resting position against the support body 2 to a position where the pins 12, 14 are at the distal ends of support brackets 4 and 6. In this way, a sheet of material initially resting on the top face 24 of the elevating member 16 can be lifted to the ceiling and temporarily supported while permanent attaching occurs.

The elevating plate 18 is made of the same or a harder, stronger material than the handle so that the constant rotation of the handle does not prematurely wear the elevating plate. Also, the elevating plate 18 is removable, typically with screws, so a worn plate can be replaced without replacing the entire elevating member 16.

Figure 4:
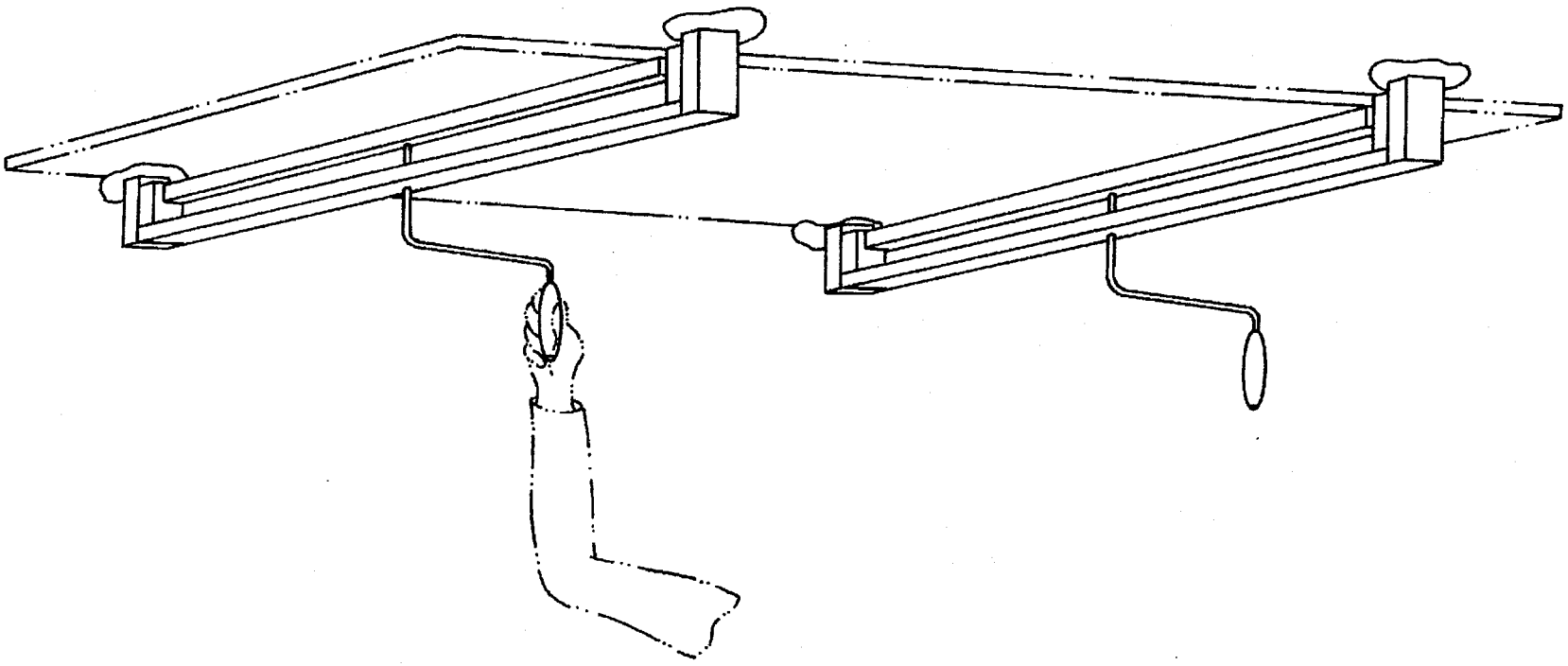
FIG. 4 is an illustration demonstrating use of the device in attaching sheets of material on a ceiling.

The procedure for affixing a sheet of material such as drywall or sheet rock to a ceiling is simply accomplished and generally is depicted in FIG. 4. While installation could be accomplished with one device modified by extending its width to assist in balancing the sheet while elevation occurs, the preferred process for installation utilizes two narrower sheet supporting devices.

First, one of the devices is secured to the ceiling, at a distance from one end of the material equalling approximately one-fourth to one-third of the overall length of the sheet of material. Second, another device is secured to the ceiling at approximately one-fourth to one-third of the sheet's length from the opposite end. This provides for even loading on each of the two devices.

Securing is accomplished easily as the device is light enough to be supported with one hand and is unloaded as it is attached. The support brackets 4 and 6 are predrilled so they contain a bore larger than the screw neck size but not larger than the screw head size. Alternatively, screws 30 and 32 can be rotatably fixed between two flanges within the bore, preventing their complete withdraw, but allowing rotation and penetration within the ceiling joist. In either case, the screws 30 and 32 pass through small apertures 34 and 36, in the support body 2, through the bores 26 and 28 in the support brackets 4 and 6, and then into the ceiling joists.

Once fully secured and attached to the ceiling with the elevating member 16 in the lower resting position, a sheet of material is slid onto the top face 24 of the elevating member so that it is in between the device and the ceiling. At this point the crank handle 22 of one or both devices are rotated, forcing the elevating members, and the sheet of material resting on its top face 24, to the ceiling.

One handle 22 can be operated independent of the other when loaded without damaging the material because the pin 12 or 14 and guide slot 8 or 10 connection means allows the elevating member 16 to swivel as well as slide. Thus, when one of the devices is elevated, the elevating member swivels, accommodating the new angle of rest, reducing the stress of the load until the second device is raised, returning both elevating members 16 and the sheet of material to a plane parallel with the ceiling.

Once the sheet of material is firmly secured and properly positioned against the ceiling joists, it can be permanently attached and the devices removed. Removal is simply an extracting of the screws 30 and 32 attached to the ceiling joist and a resetting of the elevating member 16, returning it to its resting position on top of the support body 2 by counter rotation of the handle 22. The devices are then repositioned and reattached to the ceiling joists to mount the next successive piece of material. The process is repeated until the installation of the ceiling is complete.

It is to be understood that the descriptions above are merely the preferred embodiment of the invention and the preferred process of using the invention and that variation can be made in both without deviating from the scope of the claims.

What is claimed is:

1. A material supporting device, comprising:

a support body having first and second ends;

a first and second means for securing said support body to a ceiling joist, said first and second securing means having interior faces, said first securing means being connected to said first end of said body and said second securing means being connected to said second end of said body;

an elevating member having opposite ends;

means for slidably engaging said opposite ends of said elevating member with said interior faces of said first and said second securing means; and means for lifting said elevating member, connected to said support body and contacting said elevating member.

2. A material supporting device as recited in claim 1, wherein:

said first and second securing means are support brackets having a central longitudinal bore and a screw for insertion into said central longitudinal bore, wherein the head of said screw is larger in diameter than at least one cross section of said central longitudinal bore and said threads of said screw extend outwardly from said support brackets to penetrate said ceiling joist.

3. A material supporting device as recited in claim 2, wherein:

said support brackets are fixedly attached to an upper face of said support body, such that said screw passes through said support body before entering said central longitudinal bore in said support brackets.

4. A material supporting device as recited in claim 1, wherein:

said slidably engaging means is a pin and a slot combination.

5. A material supporting device as recited in claim 4, wherein:

said pin extends axially from said opposite ends of said elevating member; and said slot is comprised of at least two rails, a cap, and said support body, whereby, said pin snugly fits within said slot without completely restricting movement within said slot.

6. A material supporting device as recited in claim 5, wherein:

said pin and slot combination further allows said elevating member to swivel by rotating about an axis defined by said pins.

7. A material supporting device as recited in claim 6, wherein:

said lifting means a threaded screw-type mechanism.

8. A material supporting device as recited in claim 7, wherein:

said threaded screw-type mechanism is a handle, having a threaded end, and a threaded insert, said threaded end of said handle having opposite threads than said threaded insert, such that said threaded end rotatably engages said threaded insert.

9. A material supporting device as recited in claim 8, further comprising:

an elevating plate removable connected to said elevating member and contacting said threaded end of said handle.

10. A material supporting device as recited in claim 9, wherein:

said handle has a rotatably gripping portion.

11. A process for hanging sheets of material on a ceiling using material supporting devices, comprising the steps of:

attaching a first material supporting device to a first ceiling;

attaching a second material supporting device to a second ceiling joist after said attaching a first material supporting device to a first ceiling joist;

inserting a sheet of material between said devices and said ceiling joists;

lifting said sheet of material flush with said ceiling joists by rotating a handle of a screw-type elevating means threaded into said devices;

securing permanently said sheet of material to said ceiling joists; and removing said devices from said ceiling joists.

* * * * *